US005288432A

United States Patent [19]

Jung

[11] Patent Number: 5,288,432

[45] Date of Patent: Feb. 22, 1994

[54] HIGH TEMPERATURE SYNTHETIC LUBRICANTS AND RELATED ENGINE LUBRICATING SYSTEMS

[75] Inventor: Alfred K. Jung, Millwood, N.Y.

[73] Assignee: Akzo America Inc., Chicago, Ill.

[21] Appl. No.: 26,227

[22] Filed: Feb. 12, 1987

Related U.S. Application Data

[63] Continuation-in-part of Ser. No. 909,432, Sep. 19, 1986, abandoned, which is a continuation-in-part of Ser. No. 811,217, Dec. 20, 1985, abandoned.

[51] Int. Cl.[5] ..... C10M 169/04; C10M 105/36

[52] U.S. Cl. ..... 252/565; 252/49.8; 252/57

[58] Field of Search ..... 252/32.5, 57, 49.8, 252/56 R, 565

[56] References Cited

U.S. PATENT DOCUMENTS

| | | | |
|---|---|---|---|
| 2,936,320 | 5/1960 | Benoit . | |
| 3,869,394 | 3/1975 | Daniels et al. | 252/565 |
| 3,912,640 | 10/1975 | Anzenberger . | |
| 4,213,847 | 7/1980 | Chen et al. . | |
| 4,402,883 | 9/1983 | Anzenberger | 260/990 |
| 4,440,657 | 4/1984 | Metro et al. | 252/565 |
| 4,519,927 | 5/1985 | Seiki | 252/49.6 |
| 4,780,229 | 10/1988 | Mullin | 252/32.5 |
| 4,879,052 | 11/1989 | Mullin | 252/565 |
| 4,956,122 | 9/1990 | Watts et al. | 252/565 |
| 4,963,292 | 10/1990 | Honna et al. | 252/565 |
| 5,139,876 | 8/1992 | Graham et al. | 428/411.1 |

FOREIGN PATENT DOCUMENTS

| | | | |
|---|---|---|---|
| 1420824 | 1/1976 | United Kingdom | C10M 3/20 |
| 1440129 | 6/1976 | United Kingdom . | |
| 2126245 | 3/1984 | United Kingdom . | |

OTHER PUBLICATIONS

J. Minzter, "Ceramics in Engines? Not Until Proven", Automotive Industries, Nov. 1986, pp. 66–67.

Mechanical Engineering, Jun. 1986, p. 30.

"Lubrication Method Uses Vapor Deposition", Chemical & Engineering News, Apr. 24, 1989, p. 35.

*Primary Examiner*—Edward A. Miller

*Attorney, Agent, or Firm*—Richard P. Fennelly; Louis A. Morris

[57] ABSTRACT

A high temperature lubricant composition comprising polycarboxylic acid esters and organophosphorus compounds is described. This composition is useful for lubricating very high temperature diesel engines. A method of rectifying used lubricant compositions is also described.

4 Claims, No Drawings

HIGH TEMPERATURE SYNTHETIC LUBRICANTS AND RELATED ENGINE LUBRICATING SYSTEMS

CROSS REFERENCE TO RELATED APPLICATIONS

This is a continuation-in-part of patent application Ser. No. 909,432 filed Sep. 19, 1996, now abandoned, which is a continuation-in-part of patent application Ser. No. 811,217 filed Dec. 20, 1985, and now abandoned.

BACKGROUND OF THE INVENTION

This invention relates to new synthetic lubricant compositions having exceptional thermal stability.

U.S. Pat. Nos. 2,396,191; 2,936,320; 3,021,357; 3,637,501; 3,912,640; and 4,080,303 are illustrative of prior art attempts to formulate lubricants containing esters of aromatic polycarboxylic acids.

U.S. Pat. No. 3,637,501 describes neo-carbon containing polycarboxylic acid esters wherein the ester groups on the aromatic nucleus contain at least one carbon atom connected directly to four other carbon atoms.

The number of lubricant patents and the importance of changes in composition found in these patents is testimony to the difficulty of making blends capable of simultaneously meeting desired criteria.

Recent technology concerning uncooled or insulated internal combustion engines requires lubricants able to withstand ring reversal temperatures in excess of 6500° F. (343.30° C.). Internal combustion engine operation at temperatures of 900° F. (482.2° C.) is being investigated. Moreover, ceramic elements in internal combustion engines may require lubricants capable of operation at temperatures in excess of 1000°0 F. (537.8° C.) or even 1200° F. (648.9° C.).

Prior art lubricants generally embody molecular structures that are resistant to thermal degradation and oxidation. These structures often incorporate highly branched or hindered carbon atom chains.

Synthetic ester oils had been recognized as useful for high temperature lubricant applications. Moreover, certain classes of esters had been considered superior in thermal properties. For example, Stauffer Chemical Company trade literature for SDL-1 TM Lubricant refers to " . . . an industry-wide consensus that polyol esters provide the best balance of high temperature stability . . . ".

The "high temperature stability" mentioned in the prior art did not contemplate extraordinary operating temperatures of 900° F. (482.2° C.) or more. These very high engine operating temperatures redefine high temperature operating requirements and necessitate entirely new lubricant formulations.

Conventional practice has been to enhance the performance of lubricants with additives such as rust inhibitors, metal deactivators, and etc. Unfortunately, these additives often solve one problem at the expense of creating another. It is desirable to develop lubricant rectification systems and methods of operating engines that do not require extensive use of additives with deleterious side effects.

FIELD OF THE INVENTION

This invention is an improved high temperature lubricant composition.

This invention is a method of lubricating internal combustion engines operating at very high temperatures.

This invention is a method of lubricating internal combustion engines wherein the lubricant is externally rectified for reuse.

This invention is also a method of rectifying (restoring to a desirable condition) the lubricant compositions of the invention.

SUMMARY OF THE INVENTION

This invention is a lubricant composition comprising as essential ingredients:

(a) from about 4 to about 96 weight percent of an organic ester ingredient capable of volatilizing or thermally degrading to fugitive molecular fragments at an internal combustion engine ring reversal temperature of at least 343° C.;

(b) from about 4 to 96 weight percent of an organophosphorus compound.

The invention is a method of lubricating internal combustion engines operating at very high temperatures (viz. about 482° C.) by contacting moving parts of an engine with the improved high temperature lubricants of this invention.

This invention is also a method of rectifying the lubricant compositions of this invention by contact with an activated alumina.

DETAILED DESCRIPTION OF THE INVENTION

The Organic Ester Ingredient

The first essential ingredient of the lubricant is a liquid organic ester. In addition, the organic ester ingredient must have a molecular weight and configuration such that it is capable of escaping with the exhaust gases of an internal combustion engine operating at ring reversal temperatures of at least 343° C. (in other words, at 343° C. or higher temperatures), and particularly at temperatures of at least 482° C. The escape of lubricant of this invention may be accomplished by (1) volatilization, (2) thermal degradation into fugitive molecular fragments, or (3) a combination of processes (1) and (2).

The term "fugitive molecular fragments" refers to low molecular weight thermal degradation and oxidative by-products of the organic ester. For example, water, carbon dioxide, carbon monoxide, methane, acetaldehyde, formic acid, etc., may be among the by-products resulting from destruction of the organic ester. Fugitive molecular fragments are by-products which do not accumulate in an internal combustion engine as tars, gums, or carbonaceous residues. The fugitive molecular fragments are of sufficiently low molecular weight to be substantially swept out of the cylinders of an internal combustion engine during very high temperature operation.

Very high temperature operation of internal combustion engines (above 482° C.) benefits from use of organic esters which minimize branched alkyl substituents. In particular, neo-carbon atom-containing esters are undesirable. These highly branched alkyl configurations are believed to promote free radical fragments which generate high molecular weight by-products capable of depositing in combustion cylinders and adjacent parts.

Organic esters useful for preparing the lubricant composition of this invention include the following classes:

(a) Aromatic polycarboxylic acid esters, in particular esters having an aromatic nucleus such as benzene, naphthalene, anthracene, or other fused ring polycyclic aromatic hydrocarbons.

(b) Polycarboxylic acid esters based on alicyclic non-aromatic nuclei such as cyclopropane, cyclobutane, cyclopentane, cyclohexane, or cycloheptane. Polycyclic non-aromatic, strained or unstrained ring polycarboxylic acid esters are also suitable. Esters having an alicyclic nucleus of 4 to 14 carbon atoms are suitable.

(c) Polycarboxylic acid esters based on cyclic or polycyclic, non-aromatic nuclei containing one or more sites of unsaturation such as cyclobutene, cyclopentene, cyclohexene, or bicycloheptadiene.

(d) Carboxylic esters of linear dicarboxylic acids represented by the formula:

$$ROOC(CH_2)_nCOOR$$

wherein n is an integer from 3 to 18 and R is a hydrocarbon radical of from 4 to 20 carbon atoms.

The esters used in this invention can be viewed as the reaction product of a polycarboxylic acid with monohydric alcohols. It is preferred that the alcohols used to prepare the esters of this invention be straight chain or only moderately branched. In particular, suitable linear dicarboxylic acid esters may be prepared from adipic, azelaic, or sebacic acids reacted with monohydroxy alcohols. The organic ester ingredient of the invention may advantageously have one or more sites of unsaturation in the acid or alcohol derived portions of its structure.

A group of preferred aromatic esters are the benzene polycarboxylic acid esters. Benzene tricarboxylic acid esters are most preferred.

Benzene Carboxylic Acid Esters as the Preferred Organic Ester Ingredient

The benzene polycarboxylic acid ester ingredient may be made up of a plurality of aromatic esters. Specifically, the benzene polycarboxylic acid ester ingredient may be made up entirely of one or more benzene tricarboxylic acid esters. Alternatively, the benzene polycarboxylic acid ester ingredient may be made up of a mixture of one or more benzene tricarboxylic acid esters with one or more benzene dicarboxylic acid esters.

The benzene carboxylic acid ester ingredient is represented by the formula:

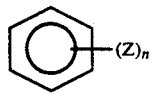

where n is on the average a number in the range greater than 2.5 and up to and including 3; and (Z) is the group, $$-\overset{O}{\overset{\|}{C}}-OR_{10}$$

wherein the (Z) groups may be the same or different, and $R_{10}$ is an organo- group having from 1 to 30 carbon atoms.

The individual esters making up the benzene polycarboxylic acid ester ingredient have n subscript values of 2 or 3. However, for the purposes of this invention, the ester ingredient considered in the aggregate should have (Z) groups substituted on the average to a value in the range over 2.5 up to and including 3. The recitation that (Z) be in excess of 2.5 refers to the desirability that benzene tricarboxylic acids be the predominant aromatic polycarboxylic species making up the ester ingredient. Preferably, the value of n is from 2.8 to 3.

When n=2 the benzene carboxylic acid ester is a derivative of a benzene dicarboxylic acid, for example, phthalic acid, isophthalic acid and terephthalic acid. When n=3 the benzene carboxylic acid ester is a derivative of a benzene tricarboxylic acid such as trimellitic acid.

Preferably, the organo radical $R_{10}$ is a hydrocarbon selected from aryl, alkyl, alkaryl, aralkyl, and cycloalkyl. Particularly preferred are straight or moderately branched chain alkyl groups wherein $R_{10}$ contains from 1 to 30 carbon atoms.

A preferred composition according to this invention is to use esters derived from both benzene tricarboxylic acids and benzene dicarboxylic acids. Thus, this lubricant may comprise from about 30 to about 60 weight percent of a mellitic acid ester and about 3 to about 10 weight percent of phthalic acid ester. In particular, a 4 to 16 carbon atom ester of benzene 1,2,4-tricarboxylic acid may be used in combination with a 4 to 16 carbon atom ester of benzene 1,2-dicarboxylic acid. The 2-ethylhexyl ester of benzene tri- and di- carboxylic acids is suitable for most lubricating applications.

The Organo Phosphorus Ingredient

The second essential ingredient of the lubricant composition is an organophosphorus compound.

Preferred organophosphorus compounds are pentavalent phosphorus compounds represented by the formula:

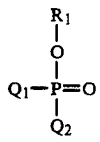

wherein $R_1$ is an organo- group, and $Q_1$ and $Q_2$ are the same or different and have the formula:

$$-OR_2$$

wherein $R_2$ is selected from $R_1$ or a hydrogen radical.

Triorganophosphates wherein $Q_1$ and $Q_2$ have the formula $-OR_2$ with $R_2$ selected from alkyl, cycloalkyl, aryl, alkaryl, and aralkyl hydrocarbon groups of from 1 to about 30 carbon atoms are suitable as the organophosphorus ingredient of this invention.

Useful organophosphorus ingredients correspond to the preceding formula where $R_1$ and $R_2$ are alkyl, aryl, aralkyl, alkaryl, or cycloalkyl groups of from 1 to 12 carbon atoms. Preferred are organophosphorus compounds where $R_1$ and $R_2$ are aryl or alkaryl groups of from 6 to 12 carbon atoms.

Extreme pressure lubricant organophosphorus compounds believed useful in the composition of the invention include reaction products of phosphites represented by the chemical equation:

$$(RO)_3P \xrightarrow{H_2O} (RO)_2POH$$

wherein the reaction product exists in a typical tautomeric equilibrium as follows:

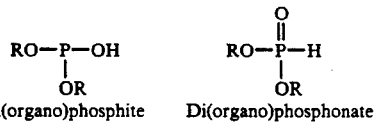

The placement of one or more hydrogen or hydroxyl groups in the pentavalent phosphorus compound results in acidic characteristics. These acidic phosphorus compounds are believed to have utility in lubricating metal and non-metal surfaces not readily wetted by less polar compounds.

The material of construction of the cylinder wall in an internal combustion engine is typically a metal such as steel. Alternative cylinder linings include special alloys, ceramics, and hard refractories such as nitrides, carbides and borides.

Other useful acidic organophosphorus ingredients for use in the lubricant composition of the invention are represented by the formula:

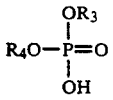

where $R_3$ and $R_4$ are the same or different hydrocarbon groups. Preferably $R_3$ and $R_4$ are aryl, alkyl, alkaryl, aralkyl, or cycloalkyl groups typically of from 1 to 12 carbon atoms.

Still other useful highly acidic organophosphorus ingredients are represented by the formula:

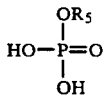

where $R_5$ is a hydrocarbon group. Preferably $R_5$ is an aryl, alkyl, alkaryl, aralkyl, or cycloalkyl group typically of from 1 to 12 carbon atoms.

The most preferred organo phosphate ingredient for lubricating applications involving metal cylinders are triarylphosphates represented by the formula:

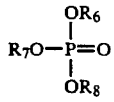

wherein $R_6$, $R_7$, and $R_8$are the same or different and are alkaryl groups represented by the formula:

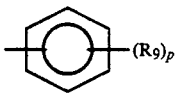

wherein ($R_9$) is a hydrogen radical or hydrocarbon group containing 2 or more carbon atoms, and p is an integer selected from 1, 2 or 3.

Examples of useful phosphate esters are tertiary butylphenyl/phenyl phosphates, secondary butylphenyl/phenyl phosphates, and isopropylphenyl/phenyl phosphates. These phosphate esters may be prepared according to the alkylation and phosphorylation procedures described in U.S. Reissue patent U.S. Pat. No. 29,540; the disclosure of which is incorporated herein by reference.

Applicant does not wish to be bound by any theory of operation for the lubricant composition taught herein. Nevertheless, it is conjectured that the benzene carboxylic acid ester (in admixture with the organo phosphate ingredient) volatilize or degrade to fugitive by-products that do not necessitate frequent shutdown of the internal combustion engine being lubricated. In contrast, other ester lubricants based on polyol esters generally deposit chars or polymeric residues after high temperature use.

PREPARATION OF THE COMPOSITION OF THE INVENTION

The composition is prepared by simply mixing the component ingredients. All ingredients are liquid and pose no special formulations problems.

The relative proportion of organic ester and organophosphorus ingredient may vary within wide limits depending on the use and the desire to optimize operation. About 4 to about 96 weight percent of each essential ingredient is required in the lubricant composition. Typically the proportion of organic ester in the lubricant is greater than the organophosphorus compound. The weight ratio of organic ester to organophosphorus compound is typically in the range of from about 1.5:1 to about 15:1.

A useful lubricant may be formulated from 30 to 94 weight percent trimellitic acid ester, 3 to 10 weight percent di(2-ethylhexyl)isophthalate, and 3 to 60 weight percent organophosphate represented by the formula:

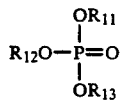

wherein $R_{11}$, $R_{12}$ and $R_{13}$ are the same or different and are selected from alkyl, aryl, and alkaryl groups.

A particularly preferred composition has 70 to 94 weight percent of trimellitic acid ester, 3 to 10 weight percent of di(alkyl)isophthalate, and 3 to 10 weight percent of organophosphate.

If desired, the composition may optionally be modified by the addition of any of a large number of conventional oil additives, rust inhibitors, metal deactivators, etc. Examples of such useful additives are zinc dialkyl dithiophosphate, alkylthio thiadiazole, and calcium petroleum sulphonates. An additive system may be used subject to the general requirement that the blend not be hazy in appearance after standing for 24 hours at 10° F. (−12.2° C.). It is also preferred that no film form on the upper surface of the blend after standing for 24 hours at 10° F. (−12.2° C.). These functional guidelines may be used to judge the compatibility of any optional component additives.

The additives of the invention should constitute no more than 20 weight percent of the composition.

The primary utility for the composition of this invention is for lubrication at temperatures far above those considered conventional for internal combustion engines (above 204° C.). Under such high temperature conditions (typically at least 343° C.), conventional additives may suffer decomposition and require premature shutdown. The preferred practice of this invention is to formulate a lubricant composition consisting essentially of the organic ester ingredient and the phosphate ester ingredient absent special additives.

THE ENGINE LUBRICATING METHOD OF THE INVENTION

This invention is an improved method of lubricating internal combustion engines at ring reversal temperatures above 900° F. (482.2° C.) by contacting the moving parts of the engine with the novel lubricant composition of this invention. Any conventional contacting method such as injecting, spraying, dipping, brushing, or padding may be employed. Typical practice of the invention is to lubricate ferrous alloys although other metals such as aluminum or non-metals such as ceramics may be successfully lubricated.

The lubricant of the invention has significant application for use with advanced design internal combustion engines, particularly diesel engines. Advanced diesel engines which are uncooled or insulated benefit from the lubricant and lubrication method disclosed herein.

The method of this invention finds particular application in lubricating combustion chamber adjacent areas operating at temperatures above 900° F. (482.2° C.) extending up to and beyond about 1200° F. (648.9° C.).

Vehicles such as tanks, trucks and construction equipment may benefit greatly from this invention since maintenance time is reduced and engines of reduced weight (absent cooling systems) may be used.

The use of the novel lubricants of this invention have heretofore been described with respect to very high temperature (uncooled or insulated) internal combustion engines. However, the lubricants of this invention have general utility in any application for reducing frictional resistance between two contacting surfaces forced to roll or slide over one another. The lubricant of the invention has particular utility where the surfaces to be lubricated attain temperatures of at least 343° C., and particularly at least 482° C. Moreover, these lubricants are operable at temperatures of 648.9° C. The composition of this invention may advantageously be used on rotary or reciprocating machine parts, powered by electricity, steam, gas, liquid fuels, or dispersed solid fuels (e.g., coal slurries) etc. Steam turbines and Wankel rotary compression engines are illustrative of devices that benefit from the use of the lubricant of the invention.

The process of lubrication is accomplished by inserting a thin film of the lubricant of the invention between any contacting surfaces desired to be lubricated. Application of the lubricant may be by dripping, spraying, injecting, padding or other conventional means.

THE LUBRICANT RECTIFYING METHOD OF THE INVENTION

The very high temperatures produced by uncooled or insulated internal combustion engine operations have a pronounced tendency to degrade many conventional lubricant additives. Therefore, it is desirable to formulate lubricant compositions of this invention absent deleterious additives.

A portion of used lubricant composition of the invention will be retained in the crankcase of an operating internal combustion engine. It is a feature of this invention to continuously reclaim, enhance, and prolong engine operation by pumping the novel lubricant described herein to an engine external rectification zone. The rectification zone may comprise a vessel with inlet and outlet means containing purifying agents. This rectification zone contains as its essential component a specially activated alumina purifying agent that does not catalyze the condensation or polymerization of acidic by-products to form deleterious anhydrides and other deposit forming compounds (polyesters, aldol condensation products, etc.) by-product to form deleterious anhydrides, polyesters, aldols, etc.

Another aspect of this invention is the treatment of the used novel lubricant outside the engine environment. The lubricant composition of the invention is rectified by contact with an activated alumina having a surface that does not catalyze the formation of pyrophosphate and to neutralize acidity from lubricant decomposition and from blow-by gases.

The properties of the lubricant composition of the invention are illustrated in the following Examples.

EXAMPLE 1

The following high temperature adiabatic engine lube composition was prepared:

| | Weight % |
|---|---|
| Hatcol TM 2285 Lubricant (1) | 90.0 |
| Flexol TM 380 Plasticizer (2) | 5.0 |
| Syn-O-Add TM 8478 Oil Additive (3) | 5.0 |

(1) product of Hatco Chemical Company, primarily 2-ethylhexyl trimellitate (2) product of Union Carbide Corp., substantially di(2-ethylhexyl)isophthalate (3) product of Stauffer Chemical Company, substantially tertiarybutylphenyl/phenyl phosphate The coking properties of the above lubricant blend were determined by an oven-beaker test. For this test 10 ml. of the blend was weighed out into a beaker and placed in an oven at 750°-1000°0 F. (398.9°-537.8° C.) for several hours. After completion of the test period, the beakers were cooled, examined for char and weighed for calculation of percent weight loss. The following physical properties of the blend prepared in this example were noted:

| | |
|---|---|
| Viscosity @ | |
| 210° F. (98.9° C.) | 10.99 centistokes |
| 100° F. (37.8° C.) | 102.6 centistokes |
| Total Acidity, mg. KOH/gram | 1.85 |
| Weight percent evaporation loss | |
| @ 300° F. (148.9° C.) 22 hrs | 2.18 |
| @ 400° F. (204.4° C.) 6.5 hrs | 5.64 |
| Oven Coking Test | |
| @ 750° F. (398.9° C.) | passed |
| @ 1000° F. (537.8° C.) | passed |
| Al pan | passed |
| Specific Gravity @ 77° F. (25° C.) | 0.97 |

EXAMPLE 2

An uncooled NH-250 diesel engine successfully completed 250 hours of operation using the lubricant composition of Example 1.

The test engine had no water in either the heads or block. A preliminary inspection after 75 hours showed that the lubricant performed much better than the comparison lubricants. The comparison lubricants had problems of high deposit formation and high oil consumption. The lubricant of this example reduced both of these problems. Little wear and low deposits were seen at 75 hours running time.

The test results are summarized in Table I as follows:

TABLE 1

UNCOOOLED 250 TEST SUMMARY

| | Build Number | | |
|---|---|---|---|
| | A | B | C |
| Lubricant | Polyolester w/35% Phosphate Ester[1] | Benzene Trimellitate[2] | Composition of Example 1 |
| Oil Consumption | 13 oz/hr (.384 liters/hr) | 26 oz/hr (7.69 liters/hr) | 10 oz/hr (.296 liters/hr) |
| Wear | Moderate | High | Low |
| Deposits | Very high | Moderate | Low |
| Test Hours | 50 | 70 | 75 |
| TRR Temp.[3] | 750° F. (399° C.) | 750° F. (399° C.) | 700° F. (371° C.) |

[1]Synthetic lubricant containing the tripelargonate ester of trimethylolpropane, triisostearate ester of trimethylolpropane, triheptanoate ester of trimethylolprane.
[2]Benzene trimellitate, ester sold as Hatco 2285 by Hatco Chemical Company.
[3]TRR Top ring reversal temperature is measured with a thermocouple inserted into the engine very near the high compression end of the piston stroke.

EXAMPLE 3

This is a prophetic example describing a predicted process of using activated alumina to rectify the lubricant of the invention.

A diesel engine absent a circulating water cooling system is operated at a ring reversal temperature in excess of 343° C. A lubricant (not actually prepared) of the following composition is used in the engine:

| Ingredient | Weight % Range |
|---|---|
| n-octyltrimellitate | 70–90 |
| di(n-octyl)isophthalate | 5–25 |

-continued

| Ingredient | Weight % Range |
|---|---|
| n-butylphenyl/phenyl phosphate | 5–25 |

No additive is used in the lubricant composition.

The used lubricant in the diesel engine crankcase is continually circulated to a rectification zone external to the engine. The rectification zone is a cartridge containing specially activated alumina. The alumina is treated to prevent the condensation or polymerization of acidic by-product to form deleterious anhydrides and other deposit forming compounds (polyesters, aldol condensation products, etc. The activated alumina filter is capable of greatly extending engine life and removes the requirement of introducing additives into the lubricant formulation.

(end of Prophetic Example)

It will be appreciated that the instant specification and Examples are set forth by way of illustration and not limitation, and that various modifications and changes may be made without departing from the spirit of the present invention.

What is claimed is:

1. A method of lubricating an internal combustion engine operating at a ring reversal temperature of at least 343° C. which comprises contacting the moving parts of the engine with a lubricant composition comprising a predominant amount of a non-neo-carbon polycarboxylic ester ingredient capable of escaping with the exhaust gases of the engine when operated at such a temperature and a lesser amount of an organophosphorus compound, wherein said polycarboxylic ester ingredient comprises a blend of a predominant amount of a benzene tricarboxylic ester with a lesser amount of a benzene dicarboxylic acid ester.

2. The method of claim 1 which further comprises the step of thereafter contacting the lubricant composition in an external zone with activated alumina to neutralize acidity in the lubricant composition.

3. The method of claim 1 which comprises use of a lubricant comprising from about 70 weight percent to about 94 weight percent of trimellitic acid ester ingredient, from about 3 weight percent to about 10 weight percent of di(alkyl) isophthalate ingredient, and from about 3 to a bout 10 weight percent of organophosphate.

4. The method of claim 3 which further comprises the step of thereafter contacting the lubricant composition in an external zone with activated alumina to neutralize acidity in the lubricant composition.

* * * * *